United States Patent [19]

Sumida

[11] Patent Number: 4,980,725

[45] Date of Patent: Dec. 25, 1990

[54] BACKGROUND ACCENUATING IMAGE FORMING APPARATUS

[75] Inventor: Hiroyasu Sumida, Ichikawa, Japan

[73] Assignee: Ricoh Company, Ltd., Tokyo, Japan

[21] Appl. No.: 295,393

[22] Filed: Jan. 10, 1989

[30] Foreign Application Priority Data

Jan. 12, 1988 [JP] Japan ..... 63-3219

[51] Int. Cl.[5] ..... G03G 15/06

[52] U.S. Cl. ..... 355/245; 355/328; 355/243

[58] Field of Search ..... 355/245, 246, 328, 326, 355/243

[56] References Cited

U.S. PATENT DOCUMENTS 4,721,978 1/1988 Herley ..... 355/328
4,769,675 9/1988 Watanabe ..... 355/328 X
4,771,314 9/1988 Parker et al. ..... 355/328
4,777,510 10/1988 Russel ..... 355/328

*Primary Examiner*—R. L. Moses
*Attorney, Agent, or Firm*—Oblon, Spivak, McClelland, Maier and Neustadt

[57] ABSTRACT

When it is desired to provide a particular region of an image of a document with a background which is different in color from the background of the other region, an image forming apparatus controls the amount of toner supply for implementing the background of the particular region to produce a solid image of density which remains constant at all times in the particular region. The amount of toner fed to a developing unit for producing the solid image is controlled in matching relation to the area of a desired solid image region or a ratio of magnification change.

5 Claims, 8 Drawing Sheets

BACKGROUND ACCENUATING IMAGE FORMING APPARATUS

BACKGROUND OF THE INVENTION

1. Field of the Invention

The present invention relates to an image forming apparatus capable of accentuating a particular part of an image of a document by rendering the background of the particular part in a color different from a color of the background of the other part. More particularly, the present invention relates to an image forming apparatus which, in the event that a solid image representative of the background of the particular part is to be formed, controls the amount of toner of the different color to thereby form the solid image with constant density at all times.

2. Discussion of the Background

There has been proposed an electrophotographic copier, facsimile apparatus, laser printer or similar image forming apparatus which is operable in a so-called undercolor mode for rendering the background of a particular area of an image of a document in the form of a solid image which is different in color from the background of the other area of the image for the purpose of accentuating the particular part. With an electrophotographic copier, for example, it has been customary to implement such an undercolor mode by any of two different types systems: a constant or non-controlled supply type system in which an amount of toner supply per copy for forming a solid image is determined beforehand on the basis of an average image occupation ratio of documents of ordinary use so as to supply the same amount of toner without exception, and a controlled supply type system in which a reference pattern of predetermined density is formed on a drum and the amount of toner supply is controlled by sensing the density. For example, a solid image may be formed by red toner in a particular part or region of a document image so as to accentuate the information lying in that part in distinction from the other information.

A problem with the constant supply type system stated above is as follows. When a solid image representative of the background of a particular region of a document image has a relatively large area, the density of the solid image is lowered because the amount of toner supply is constant and not variable. Conversely, when the area of the solid image is relatively small, the density of the solid image is increased for the same reason resulting in the toner being scattered around or even the information in the particular part being practically smeared out. On the other hand, the controlled supply type system cannot form a solid image without resorting to a complicated sequence of steps, i.e., causing optics to scan a reference pattern to expose a photoconductive drum imagewise, sensing the density of the reference pattern produced on the drum, selecting an amount of toner supply based on the sensed density, turning off a lamp of the optics, and turning on an eraser to erase an electrostatic charge which has been deposited in the area other than the solid image. Further, such a procedure slows down the copying operations.

SUMMARY OF THE INVENTION

It is therefore an object of the present invention to provide an image forming apparatus operable to form in the background of a particular part of a document image a solid image which is different in color from the other part so as to accentuate information lying in that particular part, and capable of providing the solid image with constant density at all times by controlling the amount of toner supply for forming the solid image.

It is another object of the present invention to provide a generally improved image forming apparatus.

An image forming apparatus for forming in a background of a desired region of an image of a document a solid image of a color which is different from a color of a background of the other region of the document by using toner supplied from a developing unit of the present invention comprises a solid image forming device for forming the solid image on a paper sheet, a marking device for marking a region in which the solid image is to be formed, a toner supplying device for supplying toner to be used for forming the solid image to the developing unit, and a toner amount controlling unit for controlling an amount of toner to be supplied by the toner supplying device on the basis of at least one of an area of the region of the solid image and a ratio of magnification change.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
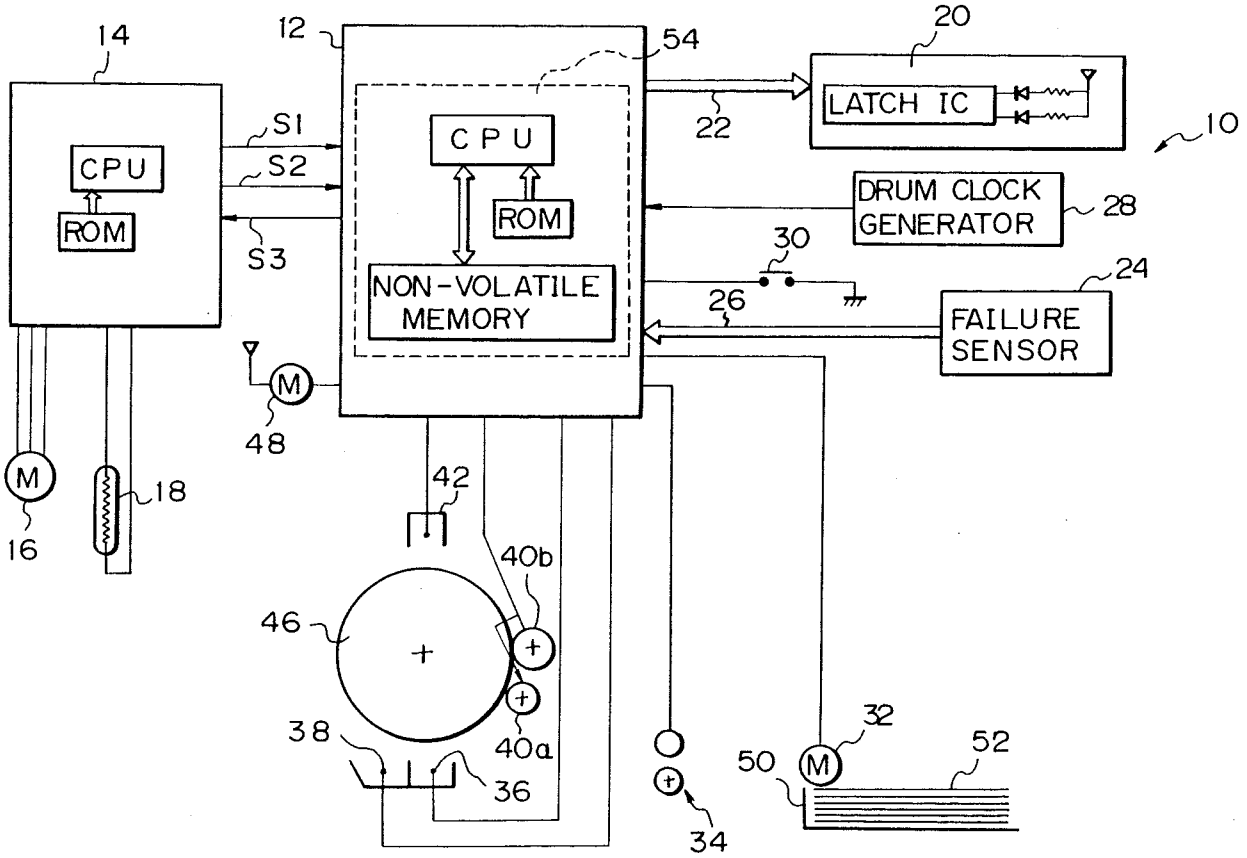
FIG. 1 is a schematic block diagram of an image forming apparatus embodying the present invention.
Figure 2:
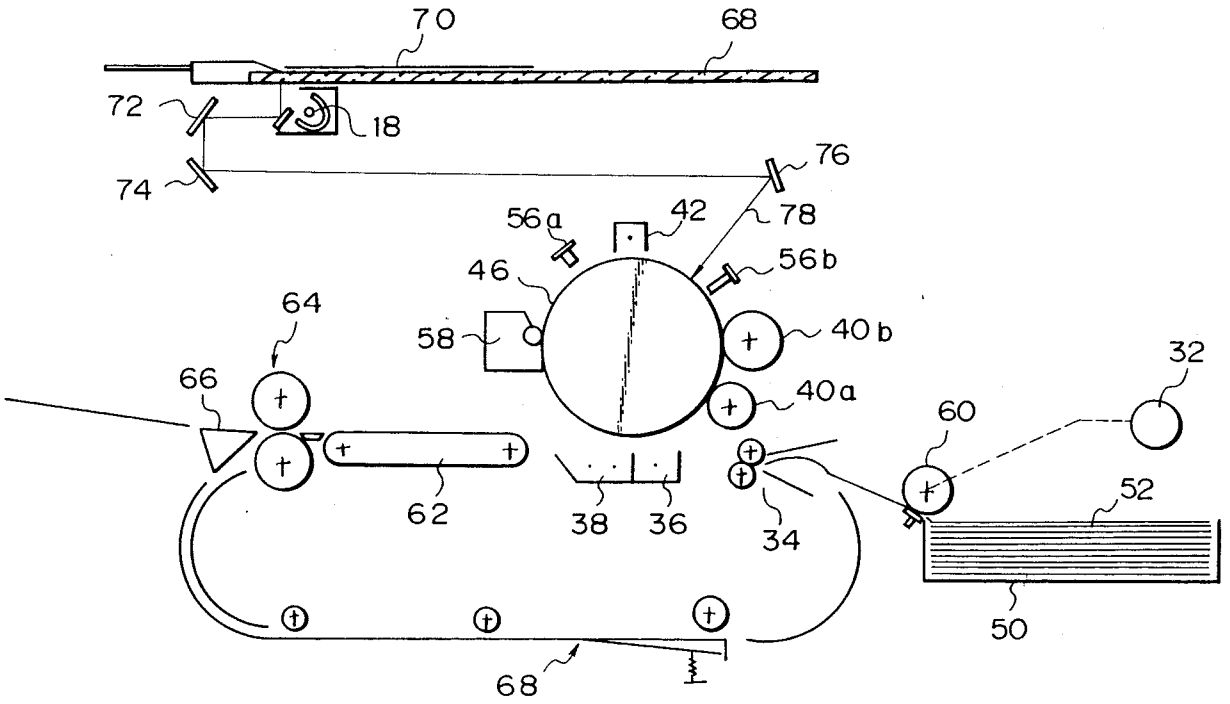
FIG. 2 is a fragmentary enlarged view of the apparatus shown in FIG. 1.

Referring to FIG. 1 of the drawings, an image forming apparatus embodying the present invention is shown and implemented as an electrophotographic copier by way of example. In the figure, an optics controller 14 is connected to a sequence controller 12. The optics controller 14 delivers a control signal to a scanner motor 16 to drive it and a control signal to a lamp 18 to turn it on. In the event of a failure, a failure code signal S1 is fed from the optics controller 14 to the sequence controller 12. Further fed from the optics controller 14 to the sequence controller 12 is a lead edge signal S2. The sequence controller 12 in turn delivers a scanner control command signal and a lamp control command signal S3 to the optics controller 14. An eraser unit 20 is connected to the sequence controller 12 by a data bus 22 so that a clock signal, latch signal, enable signal and data signal may be fed from the sequence controller 12 to the eraser unit 20. A failure sensor 24 feeds various kinds of failure data to the sequence controller 12 over a data bus 26. Further connected to the sequence controller 12 are a drum clock generator 28, a print switch 30, a paper feed motor 32, a register roller 34, a transfer charger 36, a separation charger 38, developing units 40a and 40b, a charger 42, and a toner amount adjusting motor 48. In the figure, the reference numerals 46, 50 and 54 designate respectively a photoconductive drum, a sheet cassette loaded with a stack of paper sheets 52, and a microcomputer.

Arranged around the drum 46 are eraser units 56a and 56b and a cleaning unit 58 in addition to the developing units 40a and 40b, transfer charger 36 and separation charger 38. When the paper feed motor 32 is rotated, a feed roller 60 is driven by the motor 32 to feed the paper sheets 52 one by one from the cassette 50. Each paper sheet 52 is nipped by the register rollers 34 to be transported between the transfer charger 36 and separation charger 38 and the drum 46. Transported between the chargers 36 and 38 and the drum 46, the paper sheet 52 is guided by a guide 62 toward a fixing unit 64. The paper sheet 52 coming out of the fixing unit 64 may be routed to a buffer tray 68 by a switchover pawl 66 and then fed again to between the drum 46 and the chargers 36 and 38 as needed. A glass platen 68 is disposed above the drum 46 to be loaded with a document 70. A lamp 18 is interposed between the drum 46 and the glass platen 68 for illuminating the surface of the document 70 which faces the glass platen 69. An imagewise reflection or image light 78 from the document 70 is sequentially reflected by mirrors 72, 74 and 76 to become incident to the surface of the drum 46.

Numeral keys and a # key are arranged on the top of the copier body and accessible for entering in the sequence controller 12 a solid image region 80 of a document 70 which is marked in terms of coordinates $X_1$, $X_2$, $Y_1$ and $Y_2$. The microcomputer 54 built in the sequence controller 12 delivers various control command signals to the optics controller 14, toner amount adjusting motor 48, charger 42, eraser units 56a and 56b, developing units 40a and 40b, register rollers 34, transfer charger 36, separation charger 38, paper feed motor 32 and switchover pawl 66 in response to the various signals which are applied to the sequence controller, as stated earlier. In the illustrative embodiment, the charger 42, eraser units 56a and 56b, developing units 40a and 40b, transfer charger 36, separation charger 38, fixing unit 64 and microcomputer are the major components which serve as means for forming a solid image. The numeral keys and # key, not shown, constitute means for marking a particular region of a document. The toner amount adjusting motor 48 plays the role of toner supplying means. Further, the microcomputer serves the function of toner amount controlling means.

Figure 3:
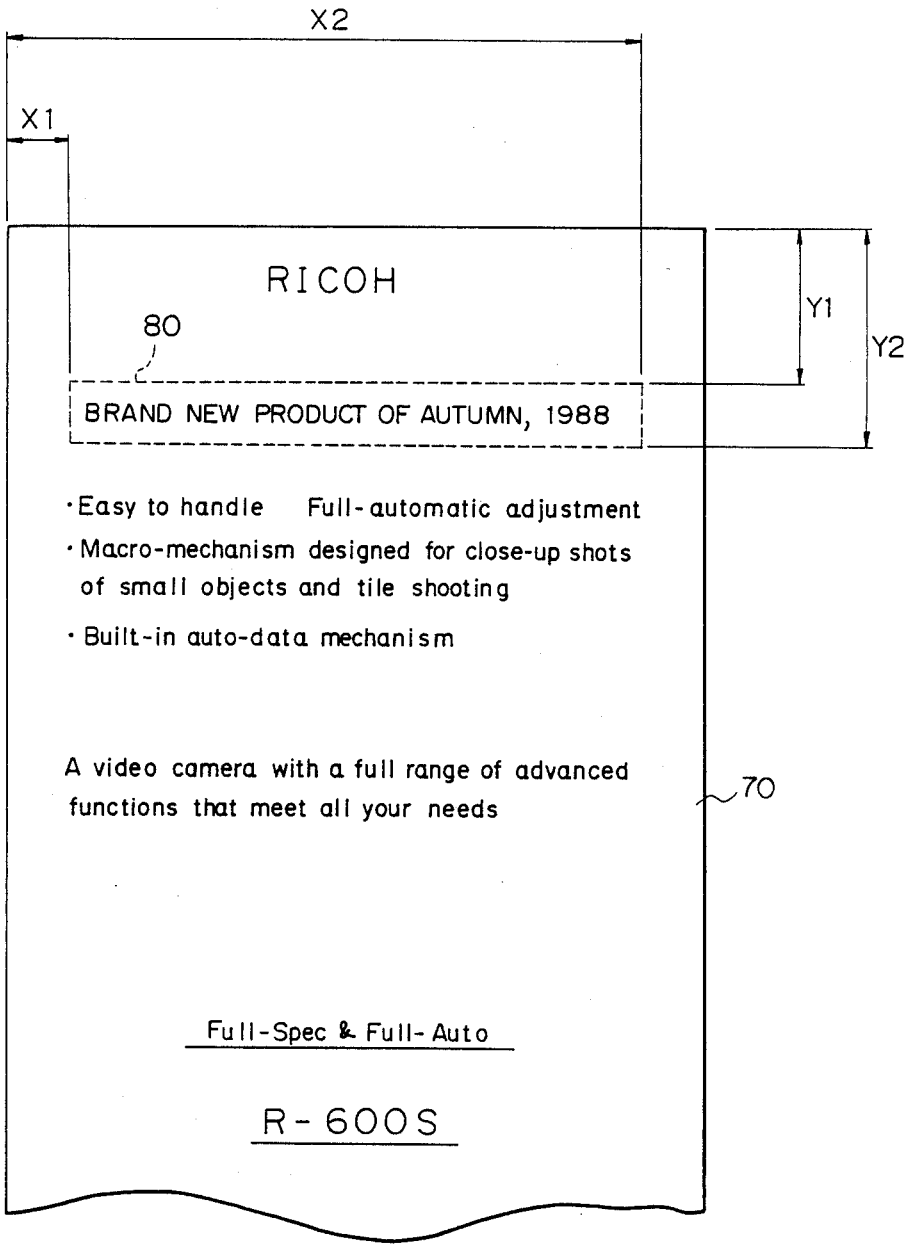
FIG. 3 exemplarily shows a document a part of which is to be rendered by a solid image as indicated by coordinates.
Figure 4:
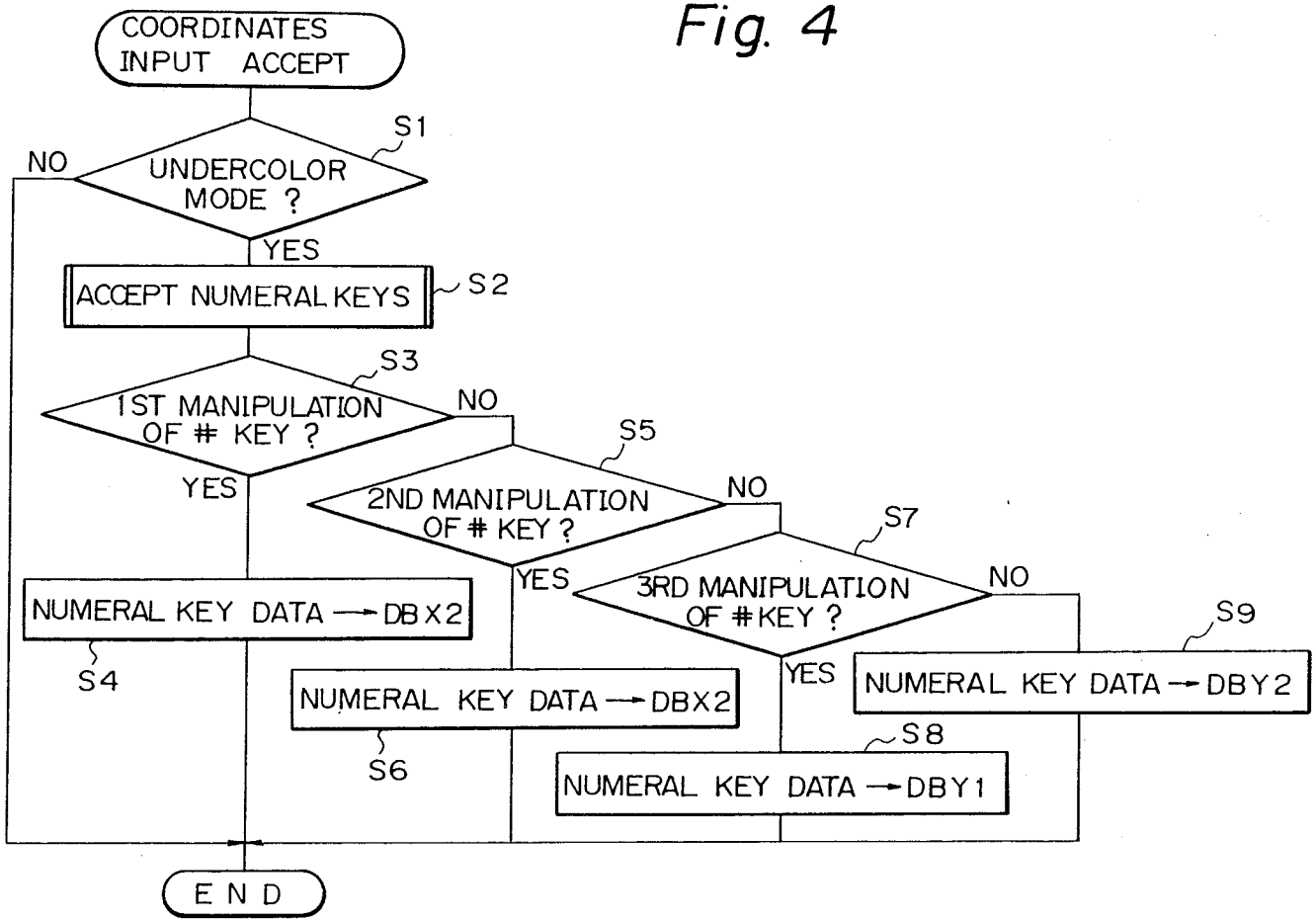
FIG. 4 is a flowchart demonstrating a procedure for accepting coordinates data of a solid image being entered.

In operation, assume that the solid image region 80 is to be marked on the document 70 shown in FIG. 3. A program shown in FIG. 4 begins with a step $S_1$ for determining whether an undercolor mode has been selected. If the answer of the step $S_1$ is YES, the program advances to a step $S_2$ for accepting coordinates which are sequentially entered on the numeral keys. Specifically, the coordinates $X_1$, $X_2$, $Y_1$ and $Y_2$ are sequentially entered in the microcomputer 54 of the sequence controller 12 by the first, second, third and fourth manipulations of the # key, respectively. Then, in a step $S_3$, whether the manipulation of the # key is the first manipulation is determined and, if the answer is YES, a step $S_4$ is executed to write numeral key data associated with the coordinate $X_1$ in a memory DBX1 which is built in the microcomputer 54.

If the manipulation of the # key is not the first manipulation as decided in the step $S_3$, the program is transferred to a step $S_5$ to see if it is the second manipulation. If the answer of the step $S_5$ is YES, a step $S_6$ is executed to write numeral key data associated with the coordinate $X_2$ in a memory DBX2 of the microcomputer 54. If the manipulation is not the second manipulation as decided in the step $S_5$, the operation advances to a step $S_7$ for determining whether the manipulation of the # key is the third manipulation and, if the answer is YES, the step $S_7$ is followed by a step $S_8$ to write numeral key data associated with the coordinate $Y_1$ in the memory DBY1. If the answer of the step $S_7$ is NO, a step $S_9$ is executed to write numeral key data associated with the coordinate $Y_2$ in a memory DBY2. By the procedure described so far, all the coordinates $X_1$, $X_2$, $Y_1$ and $Y_2$ for marking the solid image region 80 as shown in FIG. 3 have been stored in the memories DBX1, DBX2, DBY1 and DBY2, respectively.

Subsequently, the microcomputer 54 determines an amount of toner to be supplied for forming a solid image in the marked region. Specifically, when the microcomputer 54 decides that the # key has been pressed four consecutive times in a step $S_{11}$ of FIG. 5, it executes a step $S_{12}$ to subtract data stored in DBX1 from the data stored in DBX2. The result A of subtraction is written in a memory of the microcomputer 54. The step $S_{12}$ is followed by a step $S_{13}$ for subtracting the data stored in DBY1 from the data stored in DBY2, the result B being also written in a memory. In a step $S_{14}$, by using the determined values A and B as well as a numerical value of 0.02 which corresponds to an amount of toner of 0.02 gram necessary to form a solid image of 100 square millimeters, an arithmetic operation of $A \times B \times 0.02$ is performed and the resulting product C is stored in the memory. Likewise, in a step $S_{15}$, data stored in a memory DBMAG and representative of desired magnification is multiplied by the data C, i.e., $DBMAG \times C$, and the product D is written in a memory. In a step $S_{16}$, the value D determined by the step $S_{15}$ is written in a memory DBADDC of the microcomputer 54.

Assume that the coordinates $X_1$, $X_2$, $Y_1$ and $Y_2$ shown in FIG. 3 are 30 millimeters, 200 millimeters, 100 millimeters and 130 millimeters, respectively, and the desired magnification is 115%. Then, the product F of $A \times B \times 1.15$ is produced as:

$$F = (200 - 30) \times (130 - 100) \times 1.15 = 5865 \text{ (square millimeters)} \quad \text{Eq. (1)}$$

Figure 5:
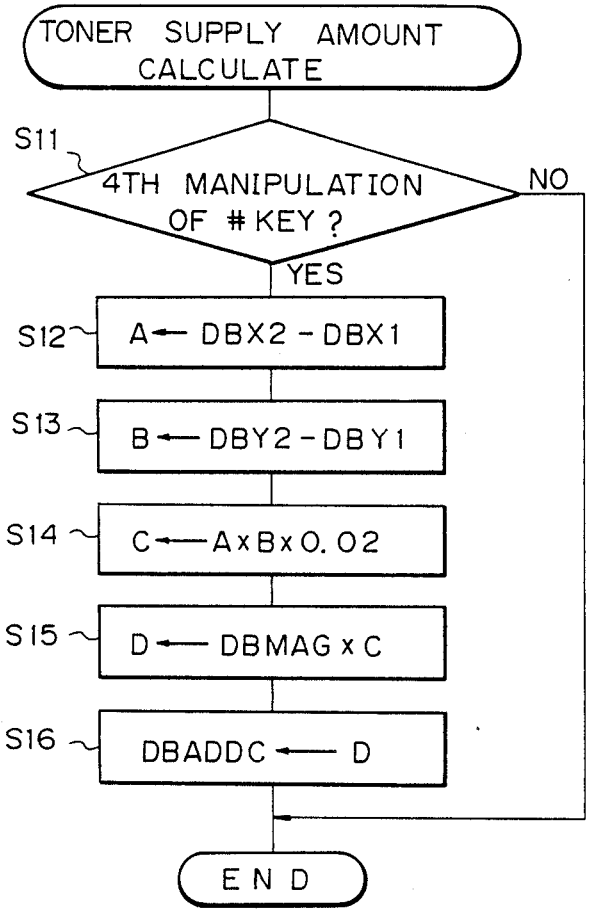
FIG. 5 is a flowchart showing a procedure for determining an amount of toner to be supplied.

In a copier of the kind described, 0.02 gram of toner is needed to form a solid image of 100 square millimeters, as stated above. Hence, the amount of toner supply determined by the step $S_{15}$ of FIG. 5 is 1.173 grams, i.e. $58.65 \times 0.02$.

Figure 6:
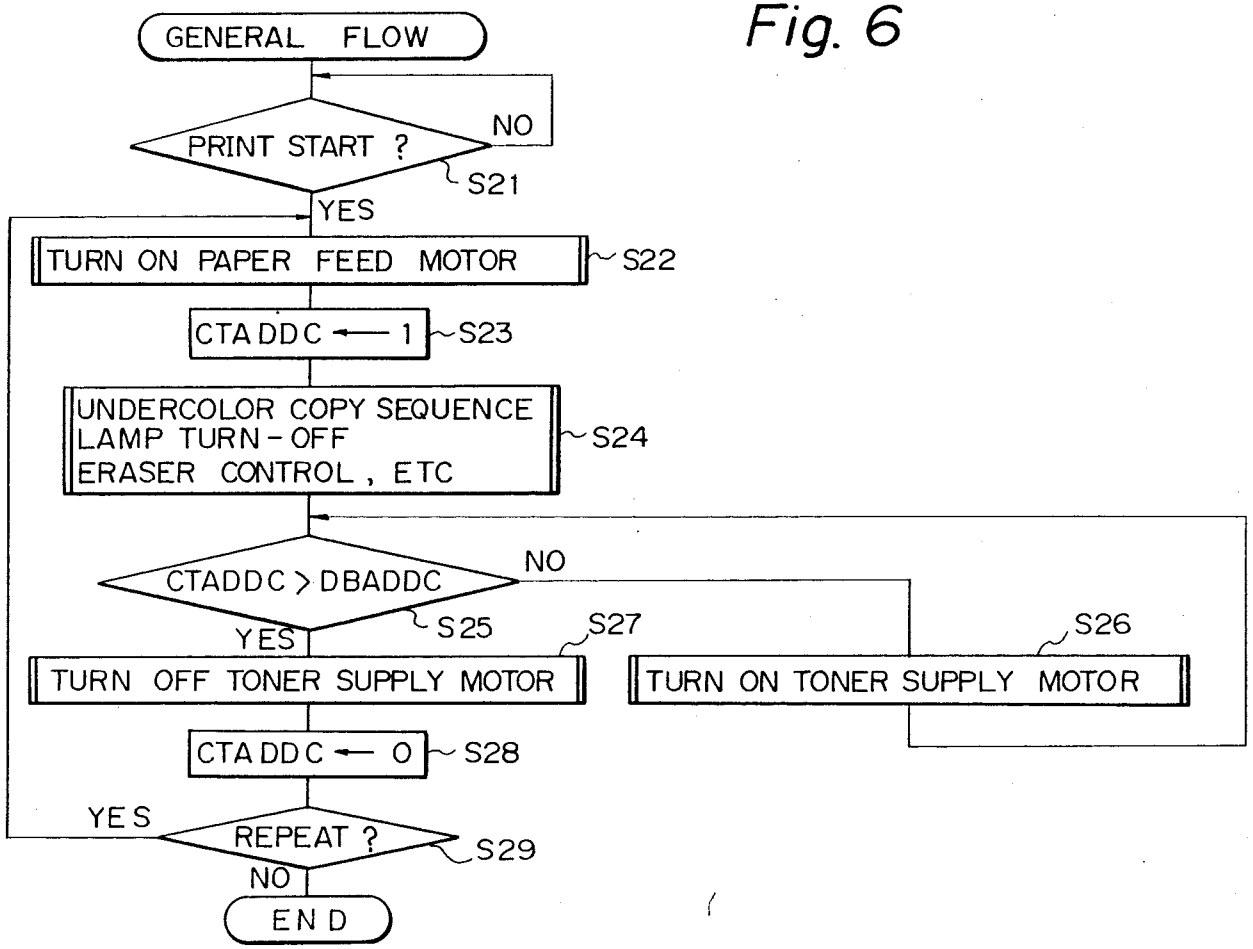
FIG. 6 is a flowchart representative of a toner supplying operation.

When a turn-on of the print switch 30 is confirmed in a step $S_{21}$ shown in FIG. 6, a step $S_{22}$ is executed for causing the sequence controller 12 to deliver a drive signal to the paper feed motor 32. Upon the drive of the paper feed motor 32, one of the paper sheets 52 is pulled out from the cassette 50 by the feed roller 60 and then temporarily retained by the register rollers 34 to be timed to the image forming system with respect to the movement. In response to the turn-on of the print switch 30, a timer CTADDC adapted for toner supply is started. In a step $S_{24}$ which follows a step $S_{23}$, an undercolor copy sequence is set up to turn off the lamp 18 and activate the eraser units 56a and 56b. Then, a step $S_{25}$ is executed for driving, in a step $S_{26}$ of FIG. 6, the toner amount adjusting motor 48 until the content CTADDC of the toner supply timer exceeds the value D (= DBADDC) which was determined by the step $S_{15}$ of FIG. 5. A clutch is opened by the rotation of the toner amount adjusting motor 48 to supply color toner to the developing unit 40a. Assuming that rotating the motor 48 for 1 second suffices for the supply of 1 gram of color toner to the developing unit 40a by way of example, the solid image whose area is determined by the Eq. (1) will be formed if the motor 48 is rotated for substantially 1.2 seconds.

Figure 7:
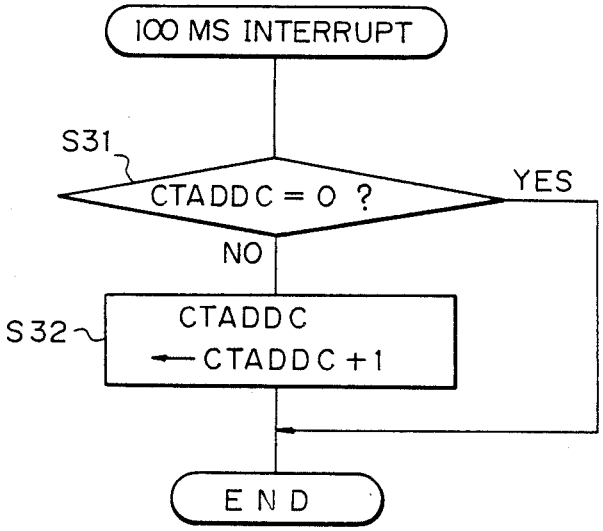
FIG. 7 is a flowchart showing the operation of a timer adapted for toner supply.

As shown in steps $S_{31}$ and $S_{32}$ of FIG. 7, the timer CTADDC repetitively counts up at the intervals of 100 milliseconds and is set upon the start of a copying operation and reset upon the turn-off of the toner amount adjusting motor 48. Referring again to FIG. 6, when CTADDC is determined to be greater than DBADDC in the step $S_{25}$, a step $S_{27}$ is executed to turn off the toner amount adjusting motor 48 and, then, followed by a step $S_{28}$ for resetting the timer CTADDC. Subsequenty, the program advances to a step $S_{29}$ to see if such a copying operation is to be repeated with another paper sheet 52.

By the above procedure, a copying operation is performed with an adequate amount of color toner being supplied to the developing unit 40a. While the lamp 18 is turned off, the eraser units 56a and 56b are turned on and the charger 42 is energized to remove the charge deposited on the drum 46 except for the solid image region 80. The resulting solid image region 80 in the form of a latent image is developed by the developing unit 40a to become a red toner image, for example. The toner image so provided on the drum 46 is nipped by the register rollers 34 whose gate has been opened by a drive signal from the sequence controller 12, whereby the toner image is transferred at a predetermined timing to the paper sheet 52 being transported between the drum 46 and the chargers 36 and 38. The paper sheet 52 carrying the toner image is driven toward the fixing unit 64 by the guide 62 and further toward the switchover pawl 66 whose position has been changed by a drive signal from the sequence controller 12. As a result, the paper sheet 52 with the toner image is routed to the buffer tray 68.

Figure 8:
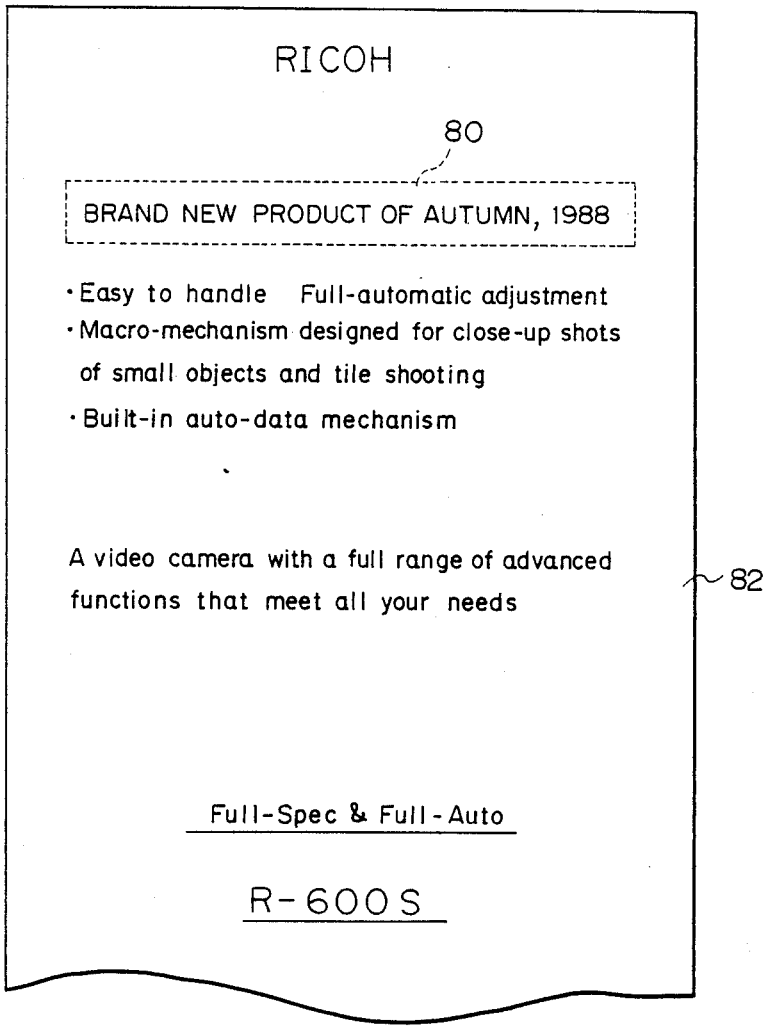
FIG. 8 shows an example of how a copy with accentuation may be produced in accordance with the present invention.

The paper sheet 52 on the buffer tray 68 is fed again toward the drum 46. Then, the lamp 18 is turned on by a signal from the optics controller 14 to effect the ordinary copying cycle. Specifically, the charger 42 deposites a charge on the drum 46 and, then, an imagewise reflection 78 from the document 70 due to light issuing from the lamp 18 is incident to the drum 46 to remove the charge on the drum 46 except for a document image area. Subsequently, the developing unit 40b develops the remaining charge or latent image on the drum 46 by using black toner, for example. The black toner image representative of the document 70 is transferred to the paper sheet 52 which is transported through the register rollers 34 to between the drum 46 and the chargers 36 and 38. The paper sheet 52 thus carrying a composite image including the solid image is transported through the fixing unit 64 to the switchover pawl 66 which is now positioned to direct the paper sheet 52 to the outside of the copier. As a result, a copy 82 having the solid image region 80 thereon as shown in FIG. 8 is produced.

As described above, in the illustrative embodiment, an adequate amount of toner determined by the microcomputer 54 in matching relation to the area of the solid image region 80 is supplied to the developing unit 40a. This allows a solid image to be produced with predetermined density at all times, i.e., the copy 82 produced by the copier is clear-cut and free from the scattering of toner due to excessive density and from a solid image of low density. Further, the print control is easy and, yet, the printing rate or copying rate is prevented from being lowered despite the formation of a solid image.

While the present invention has been shown and described in relation to an electrophotographic copier, the present invention is similarly applicable to any other kind of image forming apparatus such as a facsimile apparatus or a laser printer.

Further, in the illustrative embodiment, a solid image is formed first and, then, a document image is formed over the solid image. Alternatively, a document image and a solid image may be sequentially formed in this sequence.

In summary, in accordance with the present invention an optimum amount of toner is supplied in association with the area of a desired solid image or a ratio of magnifiction change and, therefore, a solid image area is constantly provided with predetermined density. This eliminates solid images with low density and the scattering of toner which is ascribable to excessively high density, thereby insuring clear-cut reproductions. Further, the present invention prevents the image forming rate from being lowered by the formation of a solid image and thereby realizes efficient formation of quality images.

Various modifications will become possible for those skilled in the art after receiving the teachings of the present disclosure without departing from the scope thereof.

What is claimed is:

1. An image forming apparatus for forming in a background of a desired region of an image of a document a solid image of a color which is different from a color of a background of the other region of the document by using toner supplied from a developing unit, said apparatus comprising:

solid image forming means for forming the solid image on a paper sheet;

marking means for marking a region in which the solid image is to be formed;

toner supplying means for supplying toner to be used for forming the solid image to said developing unit; and toner amount controlling means for controlling an amount of toner to be supplied by said toner supplying means on the basis of at least one of an area of the region of the solid image and a ratio of magnification change.

2. An apparatus as claimed in claim 1, wherein said solid image forming means comprises said image forming apparatus.

3. An apparatus as claimed in claim 1, wherein said marking means comprises numeral keys and a # key provided on said image forming apparatus.

4. An apparatus as claimed in claim 1, wherein said toner supplying means comprises a toner amount adjusting motor.

5. An apparatus as claimed in claim 1, wherein said toner amount controlling means comprises a microcomputer.

* * * * *